US011790862B2

(12) United States Patent
Lee et al.

(10) Patent No.: US 11,790,862 B2
(45) Date of Patent: Oct. 17, 2023

(54) DISPLAY DEVICE AND METHOD OF DRIVING THE SAME USING SCALE FACTOR BASED ON LOAD VALUE

(71) Applicant: SAMSUNG DISPLAY CO., LTD., Yongin-si (KR)

(72) Inventors: Jang-Mi Lee, Hwaseong-si (KR); Kihyun Pyun, Gwangmyeong-si (KR); Hyoseok Yun, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/646,806

(22) Filed: Jan. 3, 2022

(65) Prior Publication Data

US 2022/0343867 A1 Oct. 27, 2022

(30) Foreign Application Priority Data

Apr. 27, 2021 (KR) ..... 10-2021-0054498

(51) Int. Cl.
*G09G 3/34* (2006.01)
*G09G 3/3208* (2016.01)
*G09G 3/36* (2006.01)

(52) U.S. Cl.
CPC ..... *G09G 3/3426* (2013.01); *G09G 3/3208* (2013.01); *G09G 3/3696* (2013.01); *G09G 2330/021* (2013.01); *G09G 2330/028* (2013.01)

(58) Field of Classification Search
CPC ..... G09G 3/2007–2011; G09G 3/2092–22; G09G 3/30–3291; G09G 3/3426; G09G 3/3696; G09G 5/10; G09G 2310/04; G09G 2320/0233; G09G 2320/0238; G09G 2320/0613; G09G 2320/0646; G09G 2320/103; G09G 2330/021; G09G 2330/025; G09G 2330/028; G09G 2330/04; G09G 2340/16; G09G 2360/16
See application file for complete search history.

(56) References Cited

U.S. PATENT DOCUMENTS

2008/0180367 A1* 7/2008 Lee ..... G09G 3/3225 345/80
2009/0174634 A1* 7/2009 Kohno ..... G09G 3/3233 345/84
2012/0044270 A1* 2/2012 Arkhipov ..... G09G 3/32 345/690

(Continued)

FOREIGN PATENT DOCUMENTS

KR 10-2017-0091517 8/2017

*Primary Examiner* — Keith L Crawley
(74) *Attorney, Agent, or Firm* — F. Chau & Associates, LLC

(57) ABSTRACT

A display apparatus includes a display panel having a plurality of pixels, a gate driver configured to provide a gate signal to the display panel, a data driver configured to provide a data signal to the display panel, and a driving controller configured to control the gate driver and the data driver and to receive input image data to generate output image data corresponding to the data signal. The driving controller is configured to determine a scale factor based on a total load value of previous input image data and to compare the current input image data with the previous input image data to determine whether to apply the scale factor to the current input image data.

16 Claims, 10 Drawing Sheets

(56) References Cited

U.S. PATENT DOCUMENTS

| | | | | |
|---|---|---|---|---|
| 2014/0354699 | A1* | 12/2014 | Shin | G09G 3/2022 345/690 |
| 2014/0354710 | A1* | 12/2014 | Jun | G09G 3/20 345/694 |
| 2016/0155382 | A1* | 6/2016 | Cheon | G09G 3/3258 345/76 |
| 2016/0155388 | A1* | 6/2016 | Baik | G09G 5/10 345/691 |
| 2017/0162098 | A1* | 6/2017 | Cheon | G09G 3/3258 |
| 2020/0279519 | A1* | 9/2020 | Orio | G09G 3/006 |
| 2021/0174762 | A1* | 6/2021 | Sun | G09G 3/2007 |

* cited by examiner

FIG. 3

CL=20 SF1=1

| BITL | ITL | OTL |
|---|---|---|
| 100% | 100% | 20%(SF=0.2) |
| 80% | 80% | 20%(SF=0.25) |
| 50% | 50% | 20%(SF=0.4) |
| 15% | 15% | 15%(SF=SF1) |
| 0% | 0% | 0%(SF=SF1) |

FIG. 5B

CL=20% SF2=1 SF3=0

| BITL | ITL | AL |
|---|---|---|
| 0% | 100% | 10%(SF2=1) |
| | | 20%(SF2=1)<br>(A FIRST PIXEL ROW AT WHICH AN ACCUMULATED LOAD VALUE IS 20%) |
| | | 20%(SF3=0) |
| | | 20%(SF3=0) |
| | | 20%(SF3=0) |
| | | 20%(SF3=0) |

FIG. 5C

CL=20% SF2=1 SF3=0

| BITL | ITL | AL |
|---|---|---|
| 100% | 0% | 0%(SF2=1) |
| | | 0%(SF2=1) |
| | | 0%(SF2=1) |
| | | 0%(SF2=1) |
| | | 0%(SF2=1) |
| | | 0%(SF2=1) |
| | | 0%(SF2=1) |

CL=20%
SF1=1

CL=20%
SF1=1
SF2=1
SF3=0

FIG. 7B

CL=20% SF2=1 SF3=0

| BITL | ITL | AL |
|---|---|---|
| 15% | 100% | 10%(SF2=1) |
| | | 20%(SF2=1)<br>(A FIRST PIXEL ROW AT WHICH AN ACCUMULATED LOAD VALUE IS 20%) |
| | | 20%(SF3=0) |
| | | 20%(SF3=0) |
| | | 20%(SF3=0) |

FIG. 7C

CL=20% SF2=1 SF3=0

| BITL | ITL | AL |
|---|---|---|
| 100% | 15% | 3%(SF2=1) |
| | | 6%(SF2=1) |
| | | 9%(SF2=1) |
| | | 12%(SF2=1) |
| | | 15%(SF2=1) |

DISPLAY DEVICE AND METHOD OF DRIVING THE SAME USING SCALE FACTOR BASED ON LOAD VALUE

CROSS-REFERENCE

This application claims priority under 35 U.S.C. § 119 to Korean Patent Application No. 10-2021-0054498, filed on Apr. 27, 2021 in the Korean Intellectual Property Office (KIPO), the contents of which are herein incorporated by reference in their entireties.

TECHNICAL FIELD

Embodiments of the present disclosure relate to display devices, and more particularly, relate to a display apparatus and corresponding method for adjusting a luminance of a display panel by applying scale factors to input image data.

DISCUSSION OF RELATED ART

In general, a display apparatus includes a display panel and a display panel driver. The display panel includes gate lines, data lines, and pixels connected to the gate lines and the data lines. The display panel driver includes a gate driver providing a gate signal to the pixels through the gate lines, a data driver providing a data signal to the pixels through the data lines, and a driving controller controlling the gate driver and the data driver.

When the luminance of the display panel is not adjusted based on a load of input image data, overcurrent may flow into the data driver or the display panel, unnecessary power consumption may occur, and the data driver or the display panel may be damaged depending on a magnitude of the overcurrent. Accordingly, such a related art display apparatus may adjust the luminance of the display panel by applying a scale factor to the input image data. For example, such a related art display apparatus may calculate a total load value of the input image data, and determine the scale factor based on the total load value. However, when the scale factor determined based on the total load value of the input image data without a frame memory is applied to the input image data, applying of the scale factor may result in delay of one frame. The delay of one frame may be acceptable when input image data of a previous frame and input image data of a current frame are substantially the same. However, when input image data which does not incur adjusting the luminance of the display panel is input in the previous frame and input image data which does incur adjusting the luminance of the display panel is input in the current frame, such a display apparatus may not adjust the luminance of the display panel in the current frame due to the delay of one frame. In addition, when the input image data which incurs adjusting the luminance of the display panel is input in the previous frame and the input image data which does not incur adjusting the luminance of the display panel is input in the current frame, such a related art display apparatus may unnecessarily adjust the luminance of the display panel due to the delay of one frame.

SUMMARY

Embodiments of the present disclosure provide a display apparatus that does not incur adjusting a scale factor determined based on a total load value of previous input image data when the previous input image data and current input image data are not substantially the same, sequentially accumulating a load value per pixel row of current output image data, and comparing an accumulated load value calculated by accumulating the load value per pixel row of the current output image data with a threshold load value to adjust a second reference scale factor or a third reference scale factor.

Embodiments of the present disclosure also provide a method of driving the display apparatus.

A display apparatus embodiment of the present disclosure includes a display panel having a plurality of pixels, a gate driver configured to provide a gate signal to the display panel, a data driver configured to provide a data signal to the display panel, and a driving controller configured to control the gate driver and the data driver and to receive input image data to generate output image data corresponding to the data signal. The driving controller is configured to determine a scale factor based on a total load value of previous input image data and to compare the current input image data with the previous input image data to determine whether to apply the scale factor to the current input image data.

In an embodiment, the scale factor may decrease as the total load value of the previous input image data increases.

In an embodiment, the scale factor may have a same value as a first reference scale factor when the total load value of the previous input image data is less than or equal to a predetermined threshold load value.

In an embodiment, the first reference scale factor may be 1.

In an embodiment, a comparison between the current input image data and the previous input image data may be performed by comparing a total load value of the current input image data with the total load value of the previous input image data.

In an embodiment, the driving controller may apply the scale factor to the current input image data when a difference between the total load value of the previous input image data and the total load value of the current input image data is within a predetermined difference range.

In an embodiment, the driving controller may not apply the scale factor to the current input image data, when the difference between the total load value of the previous input image data and the total load value of the current input image data is out of the difference range.

In an embodiment, the driving controller may sequentially accumulate a load value per pixel row of current output image data to calculate an accumulated load value when the difference between the total load value of the previous input image data and the total load value of the current input image data is out of the difference range.

In an embodiment, the driving controller may apply a second reference scale factor to next pixel row data of the current input image data for a next pixel row next to a current pixel row corresponding to which current pixel row data of the current input image data is output when the difference between the total load value of the previous input image data and the total load value of the current input image data is out of the difference range and when the accumulated load value is less than the threshold load value.

In an embodiment, the second reference scale factor may be 1.

In an embodiment, the driving controller may apply a third reference scale factor to the current pixel row data of the current input image data for the next pixel row next to the current pixel row to which the current pixel row data of the current input image data is output when the difference between the total load value of the previous input image data and the total load value of the current input image data is out of the difference range and when the accumulated load value is greater than or equal to the threshold load value.

In an embodiment, the third reference scale factor may be 0.

In an embodiment of a method of driving the display apparatus according to the present disclosure, the method includes determining a scale factor based on a total load value of previous input image data, comparing the current input image data with the previous input image data to generate a comparing result, determining whether to apply the scale factor to the current input image data based on the comparing result, and generating current output image data based on the current input image data.

In an embodiment, the scale factor may decrease as the total load value of the previous input image data increases.

In an embodiment, the scale factor may have a same value as a first reference scale factor, when the total load value of the previous input image data is less than or equal to a predetermined threshold load value.

In an embodiment, comparing the current input image data with the previous input image data may include comparing a total load value of the current input image data with the total load value of the previous input image data.

In an embodiment, the scale factor may be applied to the current input image data, when the comparing result indicates that a difference between the total load value of the previous input image data and the total load value of the current input image data is within a predetermined difference range.

In an embodiment, the method may further include sequentially accumulating a load value per pixel row of the current output image data to calculate an accumulated load value when the comparing result indicates that the difference between the total load value of the previous input image data and the total load value of the current input image data is out of the difference range.

In an embodiment, a second reference scale factor may be applied to next pixel row data of the current input image data for a next pixel row next to a current pixel row to which current pixel row data of the current input image data is output when the comparing result indicates that the difference between the total load value of the previous input image data and the total load value of the current input image data is out of the difference range and when the accumulated load value is less than the threshold load value.

In an embodiment, a third reference scale factor may be applied to the next pixel row data of the current input image data for the next pixel row next to the current pixel row to which the current pixel row data of the current input image data is output when the comparing result indicates that the difference between the total load value of the previous input image data and the total load value of the current input image data is out of the difference range and when the accumulated load value is greater than or equal to the threshold load value.

The display apparatus and the method of driving the display apparatus according to embodiments may accumulate the load value per pixel row of the current output image data to calculate the accumulated load value, and compare the accumulated load value to adjust a luminance of the display panel without a delay of one frame.

The display apparatus and the method of driving the display apparatus according to embodiments may prevent unnecessary power consumption generated by flowing overcurrent into the data driver or the display panel and that the data driver or the display panel is damaged depending on a size of the overcurrent by adjusting the luminance in a current frame when input image data which does not adjusting the luminance of the display panel is input in a previous frame and when input image data which requires adjusting the luminance of the display panel is input in the current frame.

The display apparatus and the method of driving the display apparatus according to embodiments may prevent that image having an undesirable low luminance is displayed by not unnecessarily adjusting the luminance in the current frame when the input image data which requires adjusting the luminance of the display panel is input in the previous frame and the input image data which does not incur adjusting the luminance of the display panel is input in the current frame.

However, the effects of the present disclosure are not limited to the above-described effects, and may be variously expanded without departing from the spirit and scope of the present disclosure.

BRIEF DESCRIPTION OF THE DRAWINGS

The above and other embodiments of the present disclosure will become more apparent by describing in detail embodiments thereof with reference to the accompanying drawings, in which:

FIG. 3 is a tabular diagram illustrating an example in which the display apparatus of FIG. 1 determines a scale factor based on a total load value of previous input image data;

FIGS. 5*a* to 5*c* are conceptual and tabular diagrams illustrating an example in which the display apparatus of FIG. 1 applies a second reference scale factor and a third reference scale factor to input image data;

FIGS. 7*a* to 7*c* are conceptual and tabular diagrams illustrating an example in which the display apparatus of FIG. 1 applies a second reference scale factor and a third reference scale factor to input image data.

DETAILED DESCRIPTION

Hereinafter, the present disclosure will be explained in detail with reference to the accompanying drawings.

Figure 1:
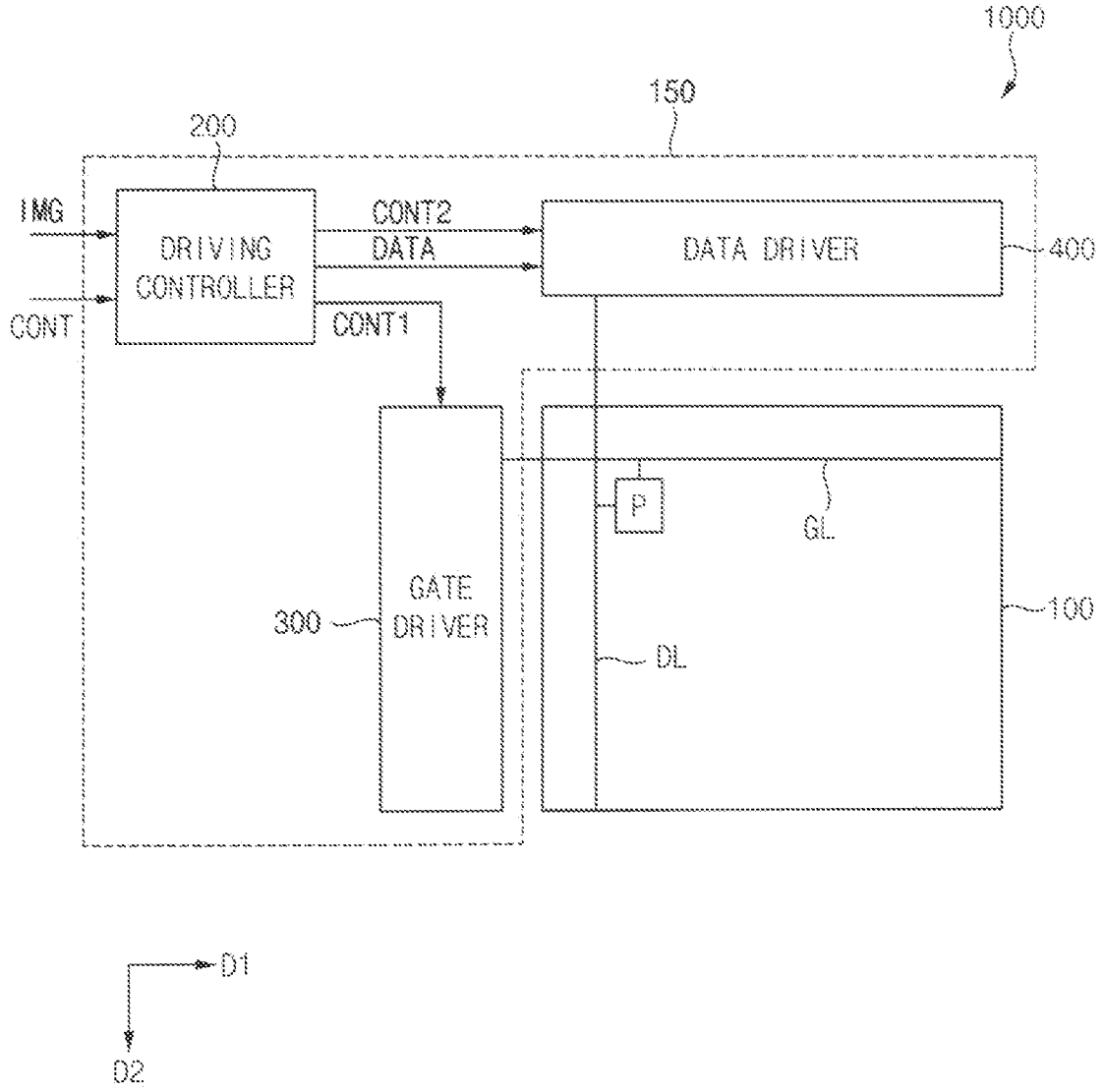
FIG. 1 is a block diagram illustrating a display apparatus according to an embodiment of the present disclosure.

FIG. 1 illustrates a display apparatus 1000 according to an embodiment of the present disclosure.

Referring to FIG. 1, the display apparatus 1000 may include a display panel 100 and a display panel driver 150. The display panel driver 150 may include a driving controller 200, a gate driver 300, and a data driver 400. According to an embodiment, the driving controller 200 and the data driver 400 may be integrated into one chip, without limitation thereto.

The display panel 100 may include a plurality of gate lines GL, a plurality of data lines DL and a plurality of pixels P electrically connected to the gate lines GL and the data lines DL. The gate lines GL may extend in a first direction D1 and the data lines DL may extend in a second direction D2 crossing the first direction D1.

The driving controller 200 may receive input image data IMG and an input control signal CONT from a host processor such as a graphic processing unit (GPU), without limitation thereto. For example, the input image data IMG may include red image data, green image data and blue image data. According to an embodiment, the input image data IMG may further include white image data. For another example, the input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, and output image data DATA based on the input image data IMG and the input control signal CONT.

The driving controller 200 may generate the first control signal CONT1 for controlling an operation of the gate driver 300 based on the input control signal CONT, and output the first control signal CONT1 to the gate driver 300. The first control signal CONT1 may include a vertical start signal, and a clock signal.

The driving controller 200 may generate the second control signal CONT2 for controlling an operation of the data driver 400 based on the input control signal CONT, and output the second control signal CONT2 to the data driver 400. The second control signal CONT2 may include a horizontal start signal and a load signal.

The driving controller 200 may generate the output image data DATA based on the input image data IMG. The driving controller 200 may output the output image data DATA to the data driver 400.

The gate driver 300 generates gate signals driving the gate lines GL in response to the first control signal CONT1 received from the driving controller 200. The gate driver 300 may output the gate signals to the gate lines GL. For example, the gate driver 300 may sequentially output the gate signals to the gate lines GL.

The data driver 400 may receive the second control signal CONT2 and the output image data DATA from the driving controller 200. The data driver 400 may convert the output image data DATA into a data voltage having an analog type. The data driver 400 may output the data voltage to the data lines DL.

Figure 2:
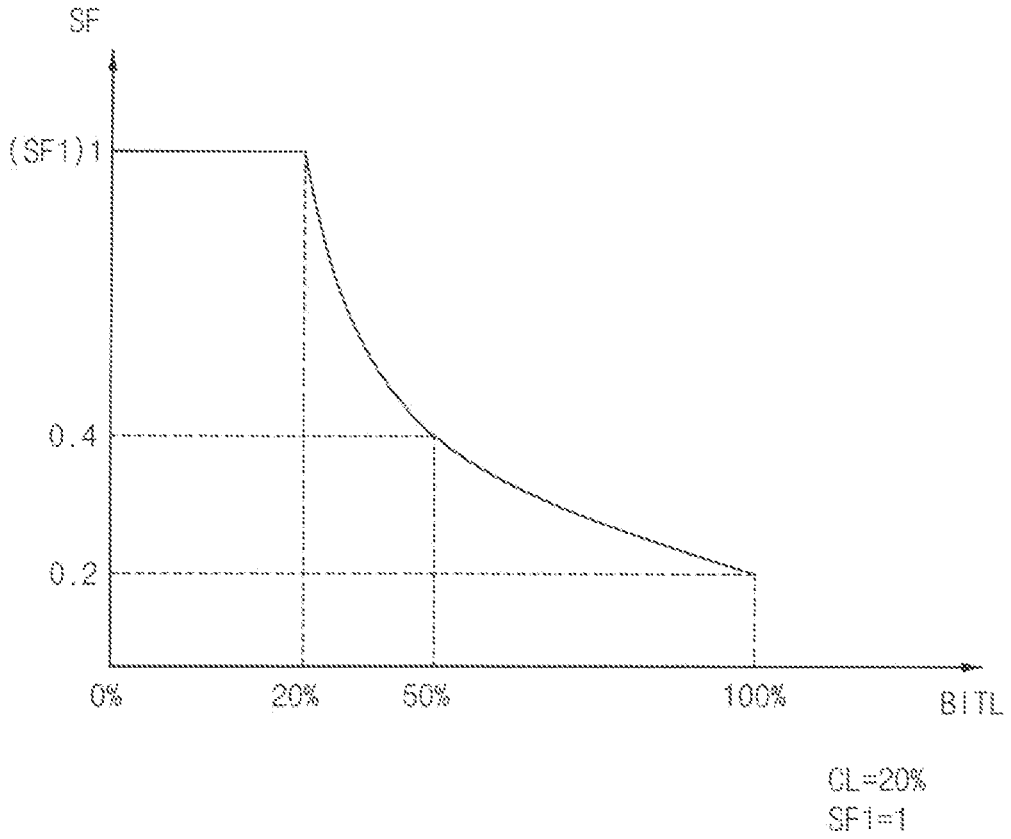
FIG. 2 is a graphical diagram illustrating an example in which the display apparatus of FIG. 1 determines a scale factor based on a total load value of previous input image data.

FIGS. 2 and 3 illustrate an example in which the display apparatus 1000 of FIG. 1 determines a scale factor SF based on a previous image total load value BITL of previous input image data. In FIG. 2, a horizontal axis of FIG. 2 represents the total load value BITL of the previous input image data, and the vertical axis of FIG. 2 represents the scale factor SF.

Referring to FIGS. 2 and 3, the driving controller 200 may determine the scale factor SF to be applied to a current input image data based on the total load value BITL of the previous input image data. The scale factor SF, a first reference scale factor SF1, a second reference scale factor SF2, and a third reference scale factor SF3 may be applied to a load value of target data such as the current input image data. Output data such as the current output image data may be generated by applying scale factors SF, SF1, SF2, and SF3 to the target data. According to an embodiment, a load value of the output data may be a value obtained by multiplying the load value of the target data by the scale factors SF, SF1, SF2, and SF3. For example, when the target data has a load value of 10% and the scale factor SF having a value of 0.5 is applied, the output data having a load value of 5% may be generated.

The driving controller 200 may determine the scale factor SF based on the total load value BITL of the previous input image data so that a value obtained by multiplying the total load value BITL of the previous input image data by the scale factor SF becomes a predetermined threshold load value CL. Meanwhile, the driving controller 200 may compare the current input image data with the previous input image data to determine whether to apply the scale factor SF to the current input image data. The driving controller 200 may generate the output image data DATA having a load value obtained by multiplying a load value of the input image data IMG by the scale factor SF. A load value may be a value of 0% to 100%. For example, when the input image data IMG is a full black image, a total load value of the input image data IMG is 0%. For example, when the input image data IMG is a full white image, the total load value of the input image data IMG may be 100%.

The scale factor SF may decrease as the total load value BITL of the previous input image data increases. In this case, the scale factor SF may have a value between about 0 and 1, inclusive. The scale factor SF may have a minimum value at which a product of the scale factor SF and 100% becomes the threshold load value CL. When the total load value BITL of the previous input image data is less than or equal to the threshold load value CL, the scale factor SF may have the same value as the first reference scale factor SF1. For example, the first reference scale factor SF1 may be 1.

For convenience of description, it is assumed that the threshold load value CL has a value of 20% in FIGS. 2 and 3. In this case, when the total load value BITL of the previous input image data is less than or equal to 20%, the driving controller 200 may determine the scale factor SF to the same value as the first reference scale factor SF1 (e.g., 1). For example, when the total load value BITL of the previous input image data is 0%, the driving controller 200 may apply the scale factor SF having the same value as the first reference scale factor SF1 (e.g., 1). For example, when the total load value BITL of the previous input image data is 0% and the current image total load value ITL of the current input image data is 0%, the output total load value OTL of the current output image data may be a value of 0% obtained by multiplying 0% by 1. For example, when the total load value BITL of the previous input image data is 15%, the driving controller 200 may apply the scale factor SF having the same value as the first reference scale factor SF1. For example, when the total load value BITL of the previous input image data is 15% and when the total load value ITL of the current input image data is 15%, the total load value OTL of the current output image data may be a value of 15% obtained by multiplying 15% by 1. When the total load value BITL of the previous input image data is 50%, the driving controller 200 may determine the scale factor SF to be 0.4 obtained by dividing the threshold load value CL by 50%. For example, when the total load value BITL of the previous input image data is 50% and when the total load value ITL of the current input image data is 50%, the total load value OTL of the current output image data may be a value of 20% obtained by multiplying 50% by 0.4. When the total load value BITL of the previous input image data is 80%, the driving controller 200 may determine the scale factor SF to be 0.25 obtained by dividing the threshold load value CL by 80%. For example, when the total load value BITL of the previous input image data is 80% and when the total load value ITL of the current input image data is 80%, the total load value OTL of the current output image data may be a value of 20% obtained by multiplying 80% by 0.25. When the total load value BITL of the previous input image data is 100%, the driving controller 200 may determine the scale factor SF to be 0.2 obtained by dividing the threshold load value CL by 100%. For example, when the total load value BITL of the previous input image data is 100% and the total load value ITL of the current input image data is 100%, the total load value OTL of the current output image data may be a value of 20% obtained by multiplying 100% by 0.2.

Meanwhile, a comparison between the current input image data and the previous input image data is performed by comparing a total load value ITL of the current input image data with the total load value BITL of the previous input image data. For example, the comparison between the previous input image data and the current input image data may be performed by comparing the sum of the grays of the previous input image data and the sum of the grays of the current input image data. Then the driving controller 200 may apply the scale factor SF to the current input image data, when a difference between the total load value BITL of the previous input image data and the total load value ITL of the current input image data is within a predetermined difference range. The driving controller 200 may not apply the scale factor SF to the current input image data when the difference between the total load value BITL of the previous input image data and the total load value ITL of the current input image data is out of the difference range. For example, the difference range may be set to a small enough value to be considered substantially the same.

For example, assuming that the difference range is 0.1% and the threshold load value CL is 20%, when the total load value BITL of the previous input image data is 0% and when the total load value ITL of the current input image data is 0%, the driving controller 200 may apply the scale factor SF having the same value as the first reference scale factor SF1 (e.g., 1). For example, assuming that the difference range is 0.1% and the threshold load value CL is 20%, when the total load value BITL of the previous input image data is 30% and when the total load value ITL of the current input image data is 30%, the driving controller 200 may apply the scale factor SF determined based on the total load value BITL of the previous input image data. For example, assuming that the difference range is 0.1% and the threshold load value CL is 20%, when the total load value BITL of the previous input image data is 30% and when the total load value ITL of the current input image data is 40%, the driving controller 200 may not apply the scale factor SF.

Figure 4:
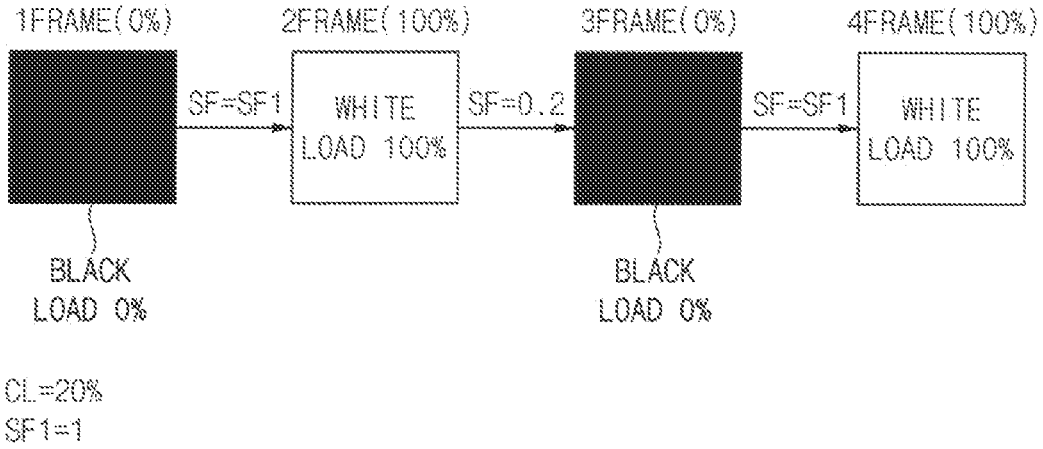
FIG. 4 is a conceptual diagram illustrating an example in which a related art display apparatus applies a scale factor to input image data.

FIG. 4 illustrates an example in which a related art display apparatus applies the scale factor SF to the input image data. In FIG. 4, each load value illustrated in a block is a load value of the output image data DATA of the respective frame.

Referring to FIG. 4, The related art display apparatus may compare the total load value BITL of the previous input image data with the total load value ITL of the current input image data, and constantly apply the scale factor SF according to a comparing result.

For example, in FIG. 4, it is assuming that a total load value of the input image data of a first frame 1Frame is 0% (BLACK gray), the total load value of the input image data of a second frame 2Frame is 100% (WHITE gray), the total load of the input image data of a third frame 3Frame is 0% (BLACK gray), the total load value of the input image data of a forth frame 4Frame is 100% (WHITE gray), the threshold load value CL is 20%, and the first reference scale factor SF1 is 1. In this case, when a current frame is the second frame 2Frame, the total load value BITL of the previous input image data is 0%. Accordingly, the scale factor SF having the same value as the first reference scale factor SF1 (e.g., 1) may be applied in the second frame 2Frame. The total load value OTL of the current output image data of the second frame 2Frame is 100% obtained by multiplying 100% which is the total load value ITL of the current input image data of the second frame 2Frame by 1. When a current frame is the third frame 3Frame, the total load value BITL of the previous input image data is 100%. Accordingly, the scale factor SF determined based on the total load value BITL of the previous input image data may be applied in the third frame 3Frame. Then since the threshold load value CL is 20%, the scale factor SF may be determined to be 0.2 obtained by dividing the threshold load value CL by 100%. The total load value OTL of the current output image data of the third frame 3Frame is 0% obtained by multiplying 0% which is the total load value ITL of the current input image data of the third frame 3Frame by 1. When a current frame is the fourth frame 4Frame, the total load value BITL of the previous input image data is 0%. Accordingly, the scale factor SF having the same value as the first reference scale factor SF1 (e.g., 1) may be applied in the fourth frame 4Frame. The total load value OTL of the current output image data of the fourth frame 4Frame is 100% obtained by multiplying 100% which is the total load value ITL of the current input image data of the fourth frame 4Frame by 1. As a result, in the second frame 2Frame and the fourth frame 4Frame, adjusting a luminance of the display panel 100 is not performed, so unnecessary power consumption may occur due to overcurrent. And, when the overcurrent is relatively large, even damage to the data driver 400 or the display panel 100 may occur.

Figure 5A:
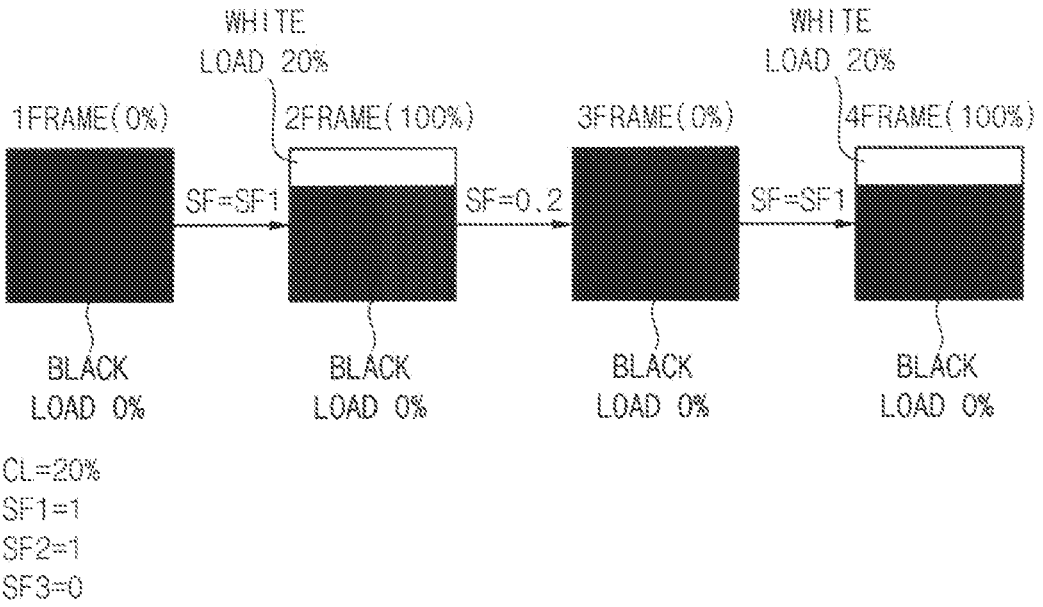

FIGS. 5*a* to 5*c* illustrate an example in which the display apparatus of FIG. 1 applies the second reference scale factor SF2 and the third reference scale factor SF3 to the input image data IMG. In FIG. 5*a*, each load value illustrated in a block is a load value of the output image data of the respective frame.

Referring to FIG. 5*a*, the driving controller 200 sequentially may accumulate a load value per pixel row of the current output image data to calculate an accumulated load value AL when the difference between the total load value BITL of the previous input image data and the total load value ITL of the current input image data is out of the difference range. The pixel row may correspond to pixels connected to one gate line GL. While the driving controller 200 provide the output image data DATA for specific pixel row to the data driver 400, the driving controller 200 may accumulate the load value of the output image data DATA for the specific pixel row to calculate the accumulated load value AL. When the difference between the total load value BITL of the previous input image data and the total load value ITL of the current input image data is out of the difference range, the driving controller 200 may apply the second reference scale factor SF2 (e.g., 1) to data of the input image data for a first pixel row. When the difference between the total load value BITL of the previous input image data and the total load value ITL of the current input image data is out of the difference range, and when the accumulated load value AL is less than the threshold load value CL, the driving controller 200 may apply the second reference scale factor SF2 (e.g., 1) to next pixel row data of the current input image data for a next pixel row next to a current pixel row to which current pixel row data of the current input image data is output. When the difference between the total load value BITL of the previous input image data and the total load value ITL of the current input image data is out of the difference range and when the accumulated load value AL is greater than or equal to the threshold load value CL, the driving controller 200 may apply the third reference scale factor SF3 (e.g., 0) to the next pixel row data of the current input image data for the next pixel row next to the current pixel row to which the current pixel row data of the current input image data is output. For example, when the third reference scale factor SF3 is applied to specific pixel row data of the input image data for a specific pixel row, the specific pixel row may display an image of BLACK gray. In this case, the difference range may be set to a small value enough to be considered substantially the same. For example, when the accumulated load value AL obtained by accumulating a load value for the first pixel row and a load value for a second pixel row become the threshold load value CL, the second reference scale factor SF2 (e.g., 1) may apply to data of the input image data for the first pixel row and data of the input image data for the second pixel row, and the third reference scale factor SF3 (e.g., 0) may apply to data of the input image data for the remaining pixel rows.

In FIG. 5*a*, it is assumed that the threshold load value CL is 20%, the second reference scale factor SF2 is 1, the third reference scale factor SF3 is 0, and the total load value of the input image data of the first frame 1Frame is 0% (BLACK gray), the total load value of the input image data of the second frame 2Frame is 100% (WHITE gray), the total load value of the input image data of the third frame 3Frame is 0% (BLACK gray), and the total load value of the input image data of the fourth frame 4Frame is 100% (WHITE gray). In this case, the difference between the total load value of the input image data of the first frame 1Frame and the total load value of the input image data of the second frame 2Frame is 100% and is out of the difference range. Accordingly, the driving controller 200 may calculate the accumulated load value AL of the second frame 2Frame. When the accumulated load value AL calculated up to a specific pixel row of the output image data of the second frame 2Frame is 20%, data of the input image data for the specific pixel row and pixel rows previous to the specific pixel row may be applied the second reference scale factor SF2 (e.g., 1). Accordingly, output image data having the WHITE gray may be output up to the specific pixel row in the second frame 2Frame. On the other hand, data of the input image data for next pixel rows next to the specific pixel row may be applied the third reference scale factor SF3 (e.g., 0). Accordingly, output image data having the BLACK gray may be output after the specific pixel row in the second frame 2Frame. As a result, the total load value of the output image data of the second frame 2Frame may be 20% due to the output image data for pixel rows up to the specific pixel row. Also, the difference between the total load value of the input image data of the second frame 2Frame and the total load value of the input image data of the third frame 3Frame is 100% and is out of the difference range. Accordingly, the driving controller 200 may calculate the accumulated load value AL of the third frame 3Frame. The second reference scale factor SF2 (e.g., 1) may be applied to data of the input image data for first pixel row. Accordingly, the output image data having the BLACK gray may be output at the first pixel row in the second frame 3Frame. The accumulated load value AL accumulated up to the first pixel row may be 0%. Since the accumulated load value AL is less than 20%, the second reference scale factor SF2 (e.g., 1) may be applied to data of the input image data for a second pixel row. Accordingly, the output image data having the BLACK gray may be output at the second pixel row in the third frame 3Frame. The accumulated load value AL accumulated up to the second pixel row may be 0%. As a result, the output image data having the BLACK gray may be output pixel rows in the third frame 3Frame. Also, the difference between the total load value of the input image data of the third frame 3Frame and the total load value of the input image data of the fourth frame 4Frame is 100% and is out of the difference range. Accordingly, the driving controller 200 may calculate the accumulated load value AL of the fourth frame 4Frame. When the accumulated load value AL calculated up to a specific pixel row of the output image data of the fourth frame 4Frame is 20%, data of the input image data for the specific pixel row and pixel rows previous to the specific pixel row may be applied the second reference scale factor SF2 (e.g., 1). Accordingly, the output image data having the WHITE gray may be output up to the specific pixel row in the fourth frame 4Frame. On the other hand, data of the input image data for next pixel rows next to the specific pixel row may be applied the third reference scale factor SF3 (e.g., 0). Accordingly, the output image data having the BLACK gray may be output after the specific pixel row in the fourth frame 4Frame. As a result, the total load value of the output image data of the fourth frame 4Frame may be 20% due to the output image data for pixel rows up to the specific pixel row. Meanwhile, for convenience of explanation, a case in which the output image data is output from an upper pixel row is illustrated in FIG. 5A, but the present disclosure is not limited to the case in which the output image data is output from the upper pixel row. As described above, since the display apparatus 1000 may adjust the luminance of the display panel 100 in the second frame 2Frame and the fourth frame 4Frame, unnecessary power consumption and damage of the data driver 400 or the display panel 100 may be prevented. That is, when input image data which does not incur adjusting the luminance of the display panel 100 is input in a previous frame and input image data which requires adjusting the luminance of the display panel 100 is input in a current frame, the display apparatus 1000 may prevent unnecessary power consumption generated by flowing the overcurrent into the data driver 400 or the display panel 100 and that the data driver 400 or the display panel 100 is damaged depending on a size of the overcurrent by adjusting the luminance in the current frame.

Referring to FIG. 5*b*, FIG. 5*b* illustrates an example of the accumulated load value AL when the total load value BITL of the previous input image data is 0% and the total load value ITL of the current input image data is 100%. Then in FIG. 5B, it is assumed that the threshold load value CL is 20%, the second reference scale factor SF2 is 1, and the third reference scale factor SF3 is 0. The difference between the total load value BITL of the previous input image data and the total load value ITL of the current input image data is 100%. In this case, the difference between the total load value BITL of the previous input image data and the total load value ITL of the current input image data may be out of the difference range. The second reference scale factor SF2 (e.g., 1) may be applied to data of the input image data for the first pixel row. When the load value of the first pixel row is 10%, the accumulated load value AL may be 10%. Still, since the accumulated load value AL is less than 20%, the second reference scale factor SF2 (e.g., 1) may be applied to data of the input image data for the second pixel row. When the load value of the second pixel row is 10%, the accumulated load value AL obtained by accumulating the load value of the first pixel row and the load value of the second pixel row may be a value of 10%+10%=20%. Since the accumulated load value AL is equal to the threshold load value CL, the third reference scale factor SF3 (e.g., 0) may be applied from the third pixel row. Since the third reference scale factor SF3 is 0, the load value of the output image data for the remaining pixel rows may be 0%. The accumulated load value AL may be a value of 20% in the remaining pixel rows except for the first pixel row.

Referring to FIG. 5*c*, FIG. 5*c* illustrates an example of the accumulated load value AL when the total load value BITL of the previous input image data is 100% and the total load value ITL of the current input image data is 0%. Then in FIG. 5C, it is assumed that the threshold load value CL is 20%, the second reference scale factor SF2 is 1, and the third reference scale factor SF3 is 0. The difference between the total load value BITL of the previous input image data and the total load value ITL of the current input image data is 100%. In this case, the difference between the total load value BITL of the previous input image data and the total load value ITL of the current input image data may be out of the difference range. The second reference scale factor SF2 (e.g., 1) may be applied to data of the input image data for the first pixel row. Since the total load value ITL of the current input image data is 0%, the load value of the first pixel row may be 0% regardless of the value of the second reference scale factor SF2 (e.g., 1). Accordingly, since the accumulated load value AL is 0% which is less than 20%, the second reference scale factor SF2 may be applied to data of the input image data for the second pixel row. Since the total load value ITL of the current input image data is 0%, the load value of the output image data for the pixel rows may be 0% regardless of the value of the second reference scale factor SF2. Accordingly, the accumulated load value AL obtained by accumulating the load values of the output image data for the pixel rows may be 0%

Figure 6:
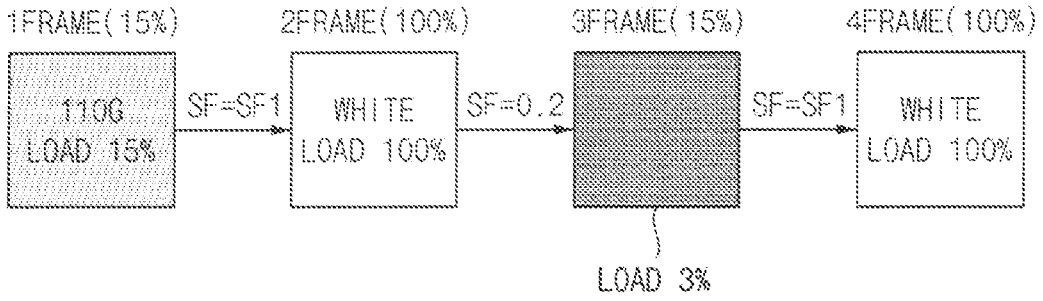
FIG. 6 is a conceptual diagram illustrating an example in which a related art display apparatus applies a scale factor to input image data.

FIG. 6 illustrates an example in which a related art display apparatus applies the scale factor to the input image data. In FIG. 6, each load value illustrated in a block is a load value of the output image data DATA of the respective frame.

Referring to FIG. 6, the related art display apparatus may compare the total load value BITL of the previous input image data with the total load value ITL of the current input image data, and constantly apply the scale factor SF according to a comparing result.

For example, in FIG. 6, it is assuming that a total load value of the input image data of a first frame 1Frame is 15% (110 gray), the total load value of the input image data of a second frame 2Frame is 100% (WHITE gray), the total load of the input image data of a third frame 3Frame is 15% (110 gray), the total load value of the input image data of a forth frame 4Frame is 100% (WHITE gray), the threshold load value CL is 20%, and the first reference scale factor SF1 is 1. In this case, when a current frame is the second frame 2Frame, the total load value BITL of the previous input image data is 15%. Accordingly, the scale factor SF having the same value as the first reference scale factor SF1 (e.g., 1) may be applied in the second frame 2Frame. The total load value OTL of the output image data of the second frame 2Frame is 100% obtained by multiplying 100% which is the total load value ITL of the current input image data of the second frame 2Frame by 1. When a current frame is the third frame 3Frame, the total load value BITL of the previous input image data is 100%. Accordingly, the scale factor SF determined based on the total load value BITL of the previous input image data may be applied in the third frame 3Frame. Then since the threshold load value CL is 20%, the scale factor SF may be determined to be 0.2 obtained by dividing the threshold load value CL by 100%. The total load value OTL of the output image data of the third frame 3Frame is 3% obtained by multiplying 15% which is the total load value ITL of the current input image data of the third frame 3Frame by 0.2. When a current frame is the fourth frame 4Frame, the total load value BITL of the previous input image data is 15%. Accordingly, the scale factor SF having the same value as the first reference scale factor SF1 (e.g., 1) may be applied in the fourth frame 4Frame. The total load value OTL of the output image data of the fourth frame 4Frame is 100% obtained by multiplying 100% which is the total load value ITL of the current input image data of the fourth frame 4Frame by 1. As a result, the display apparatus 1000 may prevent that an image having an undesirable low luminance is displayed by not unnecessarily adjusting the luminance.

Figure 7A:
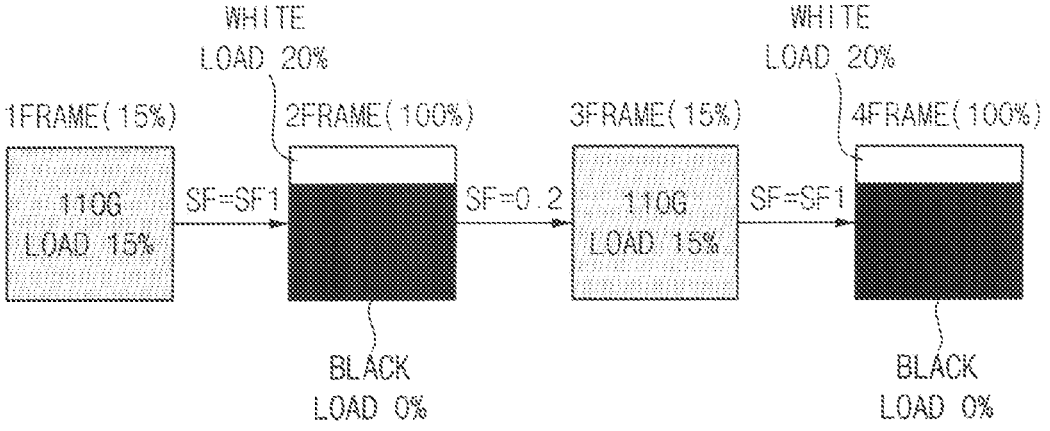

FIGS. 7A to 7C illustrate an example in which the display apparatus 1000 of FIG. 1 applies the second reference scale factor SF2 and the third reference scale factor SF3 to the input image data. In FIG. 7*a*, each load value illustrated in a block is a load value of the output image data of the respective frame.

In FIG. 7*a*, it is assumed that the threshold load value CL is 20%, the second reference scale factor SF2 is 1, the third reference scale factor SF3 is 0, and the total load value of the input image data of the first frame 1Frame is 15% (110 gray), the total load value of the input image data of the second frame 2Frame is 100% (WHITE gray), the total load value of the input image data of the third frame 3Frame is 15% (110 gray), and the total load value of the input image data of the fourth frame 4Frame is 100% (WHITE gray). In this case, the difference between the total load value of the input image data of the first frame 1Frame and the total load value of the input image data of the second frame 2Frame is 85% and is out of the difference range. Accordingly, the driving controller 200 may calculate the accumulated load value AL of the second frame 2Frame. When the accumulated load value AL calculated up to a specific pixel row of the output image data of the second frame 2Frame is 20%, data of the input image data for the specific pixel row and pixel rows previous to the specific pixel row may be applied the second reference scale factor SF2 (e.g., 1). Accordingly, output image data having the WHITE gray may be output up to the specific pixel row in the second frame 2Frame. On the other hand, data of the input image data for next pixel rows next to the specific pixel row may be applied the third reference scale factor SF3 (e.g., 0). Accordingly, output image data having the BLACK gray may be output after the specific pixel row in the second frame 2Frame. As a result, the total load value of the output image data of the second frame 2Frame may be 20% due to the output image data for pixel rows up to the specific pixel row. Also, the difference between the total load value of the input image data of the second frame 2Frame and the total load value of the input image data of the third frame 3Frame is 85% and is out of the difference range. Accordingly, the driving controller 200 may calculate the accumulated load value AL of the third frame 3Frame. The second reference scale factor SF2 (e.g., 1) may be applied to input image data for the first pixel row. Accordingly, the output image data having the 110 gray may be output at the first pixel row in the second frame 3Frame. Since the total load value of the input image data of the third frame 3Frame is 15%, when the second reference scale factor SF2 (e.g., 1) is applied to the output image data for the pixel rows, the accumulated load value AL calculated by accumulating the load values of the output image data for the pixel rows may not exceed 15%. Accordingly, the accumulated load value AL of the third frame 3Frame may not exceed the threshold load value CL in the pixel rows. As a result, the output image data having the 110 gray may be output to the pixel rows in the third frame 3Frame. Also, the difference between the total load value of the input image data of the third frame 3Frame and the total load value of the input image data of the fourth frame 4Frame is 85% and is out of the difference range. Accordingly, the driving controller 200 may calculate the accumulated load value AL of the fourth frame 4Frame. When the accumulated load value AL calculated up to a specific pixel row of the output image data of the fourth frame 4Frame is 20%, data of the input image data for the specific pixel row and pixel rows previous to the specific pixel row may be applied the second reference scale factor SF2 (e.g., 1). Accordingly, the output image data having the WHITE gray may be output up to the specific pixel row in the fourth frame 4Frame. On the other hand, data of the input image data for next pixel rows next to the specific pixel row may be applied the third reference scale factor SF3 (e.g., 0). Accordingly, the output image data having the BLACK gray may be output after the specific pixel row in the fourth frame 4Frame. As a result, the total load value of the output image data of the fourth frame 4Frame may be 20% due to the output image data for pixel rows up to the specific pixel row. Meanwhile, for convenience of explanation, a case in which the output image data is output from an upper pixel row is illustrated in FIG. 7A, but the present disclosure is not limited to the case in which output image data is output from the upper pixel row. As described above, since the display apparatus 1000 may adjust the luminance of the display panel 100 in the second frame 2Frame and the fourth frame 4Frame, unnecessary power consumption and damage of the data driver 400 or the display panel 100 may be prevented. That is, when the input image data which does not incur adjusting the luminance of the display panel 100 is input in a previous frame and the input image data which requires adjusting the luminance of the display panel 100 is input in a current frame, the display apparatus 1000 may prevent that an image having an undesirable low luminance is displayed by not unnecessarily adjusting the luminance. In other words, when the input image data which requires adjusting the luminance of the display panel is input in a previous frame and the input image data which does not incur adjusting the luminance of the display panel is input in the current frame, the display apparatus 1000 may prevent that the image having an undesirable low luminance is displayed by not unnecessarily adjusting the luminance.

Referring to FIG. 7*b*, FIG. 7*b* illustrates an example of the accumulated load value AL when the total load value BITL of the previous input image data is 15% and the total load value ITL of the current input image data is 100%. Then in FIG. 5B, it is assumed that the threshold load value CL is 20%, the second reference scale factor SF2 is 1, and the third reference scale factor SF3 is 0. The difference between the total load value BITL of the previous input image data and the total load value ITL of the current input image data is 85%. In this case, the difference between the total load value BITL of the previous input image data and the total load value ITL of the current input image data may be out of the difference range. A second reference scale factor SF2 (e.g., 1) may be applied to data of the input image data for the first pixel row. When the load value of the first pixel row is 10%, the accumulated load value AL may be 10%. Still, since the accumulated load value AL is less than 20%, the second reference scale factor SF2 (e.g., 1) may be applied to data of the input image data for the second pixel row. When the load value of the second pixel row is 10%, the accumulated load value AL obtained by accumulating the load value of the first pixel row and the load value of the second pixel row may be a value of 10%+10%=20%. Since the accumulated load value AL is equal to the threshold load value CL, the third reference scale factor SF3 (e.g., 0) may be applied from the third pixel row. Since the third reference scale factor SF3 is 0, the load value of the output image data for the remaining pixel rows may be 0%. The accumulated load value AL may be a value of 20% in the remaining pixel rows except for the first pixel row.

Referring to FIG. 7*c*, FIG. 7*c* illustrates an example of the accumulated load value AL when the total load value BITL of the previous input image data is 100% and the total load value ITL of the current input image data is 15%. Then in FIG. 7*c*, it is assumed that the threshold load value CL is 20%, the second reference scale factor SF2 is 1, and the third reference scale factor SF3 is 0. The difference between the total load value BITL of the previous input image data and the total load value ITL of the current input image data is 85%. In this case, the difference between the total load value BITL of the previous input image data and the total load value ITL of the current input image data may be out of the difference range. A second reference scale factor SF2 (e.g., 1) may be applied to data of the input image data for the first pixel row. When the load value of the input image data for the first pixel row is 3%, the accumulated load value is 3%. Yet, since the accumulated load value AL is 3% which is less than 20%, the second reference scale factor SF2 may be applied to data of the input image data for the second pixel row. When the load value of the input image data for the first pixel row is 3%, the accumulated load value calculated by accumulating a load value of the output image data for the first pixel row and a load value of the output image data for the second pixel row is 3%+3%=6%. Since the total load value ITL of the current input image data is 15%, the maximum value of the accumulated load value AL in the current frame may be 15%. Accordingly, the accumulated load value AL obtained by accumulating the load values of the output image data for the pixel rows may be 15%.

Figure 8:
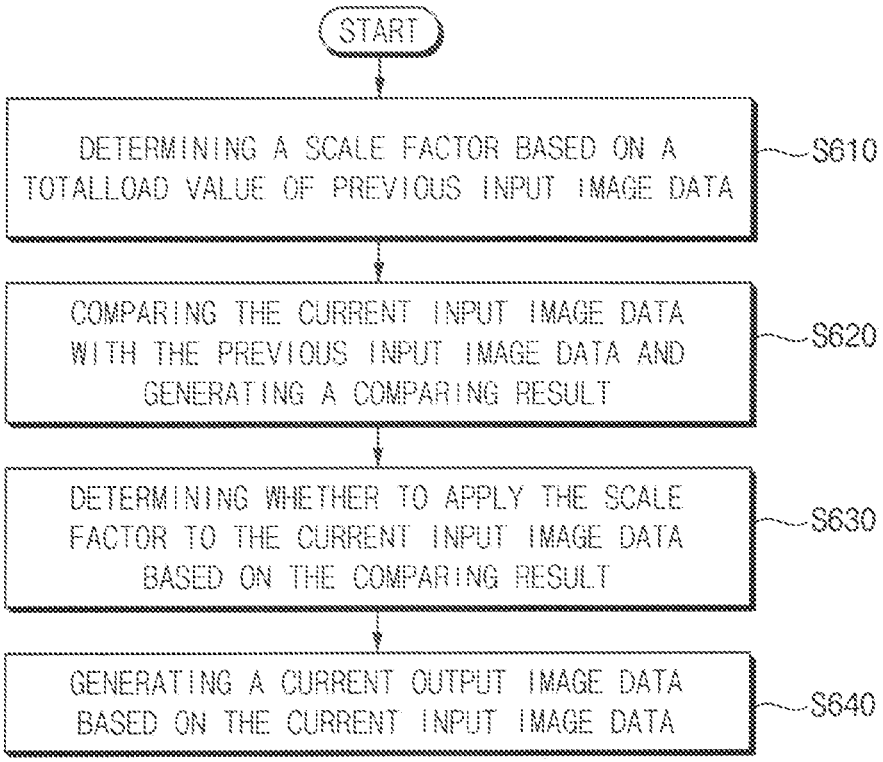
FIGS. 8 and 9 are flowchart diagrams illustrating methods of driving a display apparatus according to embodiments of the present disclosure.
Figure 9:
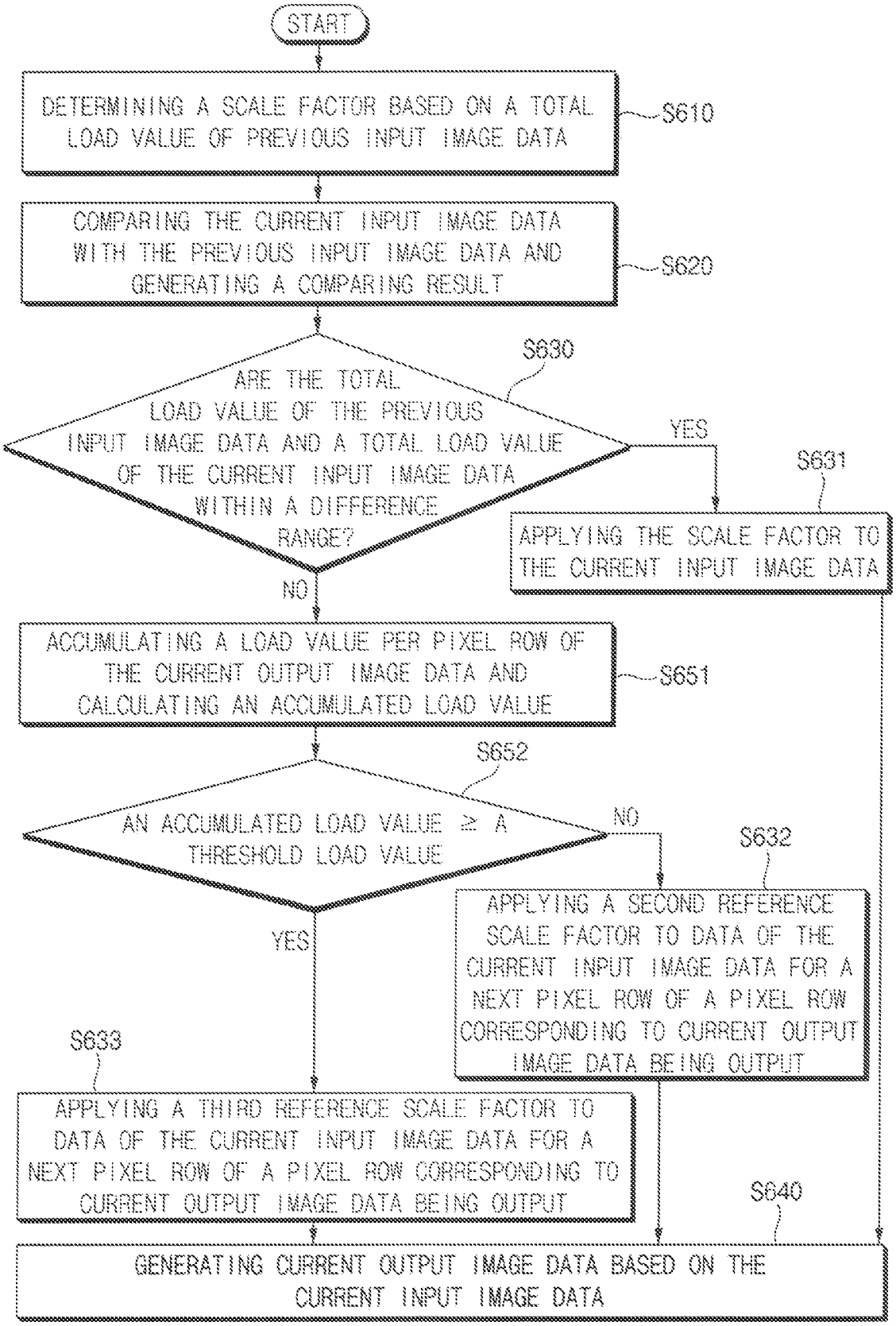

FIGS. 8 and 9 illustrate methods of driving a display apparatus according to embodiments of the present disclosure.

Referring to FIGS. 8 and 9, the method of FIG. 8 may determine the scale factor SF applied to the current input image data based on the total load value BITL of the previous input image data (operation S610), compare the current input image data with the previous input image data to generate a comparing result (operation S620), determine whether to apply the scale factor SF to the current input image data based on the comparing result (operation S630), and generate the current output image data based on the current input image data (operation S640).

In particular, the method of FIG. 8 may determine the scale factor SF applied to the current input image data based on the total load value BITL of the previous input image data (operation S610). The scale factor SF may decrease as the total load value BITL of the previous input image data increases. The scale factor SF has the same value as the first reference scale factor SF1 (e.g., 0), when the total load value BITL of the previous input image data is less than or equal to the threshold load value CL preset.

The method of FIG. 8 may compare the current input image data with the previous input image data to generate a comparing result (operation S620). In an embodiment, comparing the current input image data with the previous input image data may include comparing the total load value ITL of the current input image data with the total load value BITL of the previous input image data. For example, comparing the current input image data with the previous input image data may include comparing the sum of the grays of the current input image data with the sum of the grays of the previous input image data. Meanwhile, the comparing result may indicate whether the total load value BITL of the previous input image data and the total load value ITL of the current input image data are within the difference range preset. For example, the difference range may be set to a value small enough to be considered substantially the same.

The method of FIG. 8 may determine whether to apply the scale factor SF to the current input image data based on the comparing result (operation S630). The scale factor SF may be applied to the current input image data, when a difference between the total load value BITL of the previous input image data and the total load value ITL of the current input image data is within the difference range preset (operation S631). On the other hand, the method of FIG. 8 may sequentially accumulate the load value per pixel row of the current output image data to calculate the accumulated load value AL when the difference between the total load value BITL of the previous input image data and the total load value ITL of the current input image data is out of the difference range (operation S651). The method of FIG. 8 may compare the accumulated load value with the threshold load value CL (operation S652). The second reference scale factor SF2 (e.g., 1) may be applied to next pixel row data of the current input image data for a next pixel row next to a current pixel row to which current pixel row data of the current input image data is output when the accumulated load value AL is less than the threshold load value CL (operation S632). The third reference scale factor SF3 (e.g., 0) may be applied to the next pixel row data of the current input image data for the next pixel row next to the current pixel row to which the current pixel row data of the current input image data is output when the accumulated load value AL is greater than or equal to the threshold load value CL (operation S633).

The method of FIG. 8 may generate the current output image data based on the current input image data (operation S640). In particular, the method of FIG. 8 may apply the scale factor SF to the current input image data (operation S631) and generate the current output image data. The method of FIG. 8 may apply the second reference scale factor SF2 (e.g., 1) to the next pixel row data of the current input image data for the next pixel row next to the current pixel row to which the current pixel row data of the current input image data is output when the accumulated load value AL is less than the threshold load value CL (operation S632) and may generate the current output image data for the next pixel row. The method of FIG. 8 may apply the third reference scale factor SF3 (e.g., 0) to the next pixel row data of the current input image data for the next pixel row next to the current pixel row to which the current pixel row data of the current input image data is output when the accumulated load value AL is greater than or equal to the threshold load value CL (operation S633) and may generate the current output image data for the next pixel row.

As described above, by adjusting the luminance on the basis of the load of the current output image data, the method of FIG. 8 may prevent flowing the overcurrent into the data driver 400 or the display panel 100 and that the image having the undesirable low luminance is displayed, when the previous input image data and the current input image data are not substantially the same image data.

The disclosures may be applied any electronic device including the display apparatus 1000. For example, the disclosures may be applied to a television TV, a digital TV, a 3D TV, a mobile phone, a smart phone, a tablet computer, a virtual reality VR device, a wearable electronic device, a personal computer PC, a home appliance, a laptop computer, a personal digital assistant PDA, a portable multimedia player PMP, a digital camera, a music player, a portable game console, a navigation device, etc.

The foregoing is illustrative of the present disclosure and is not to be construed as limiting thereof. Although a few embodiments of the present disclosure have been described, those of ordinary skill in the pertinent art will readily appreciate that many modifications are possible in such embodiments without materially departing from the content of the present disclosure. Accordingly, all such modifications are intended to be included within the scope of the present disclosure as set forth in the appended claims. In the claims, any means-plus-function clauses are intended to cover the structures described herein as performing the recited function as well as structural equivalents and equivalent structures. Therefore, it is to be understood that the foregoing is illustrative of the present disclosure rather than limiting thereof, and that modifications to the disclosed and other embodiments are intended to be included within the scope and spirit of the appended claims. The present disclosure is defined by the following claims, with equivalents of the claims to be included therein.

What is claimed is:

1. A display apparatus comprising:

a display panel including a plurality of pixels;

a gate driver configured to provide a gate signal to the display panel;

a data driver configured to provide a data signal to the display panel; and a driving controller configured to control the gate driver and the data driver and to receive input image data to generate output image data corresponding to the data signal, wherein the driving controller is configured to determine a scale factor based on a total load value of previous input image data, and to compare the current input image data with the previous input image data to determine whether to apply the scale factor to the current input image data, wherein a comparison between the current input image data and the previous input image data is performed by comparing a total load value of the current input image data with the total load value of the previous input image data, and wherein the driving controller applies a second reference scale factor to next pixel row data of the current input image data for a next pixel row next to a current pixel row to which current pixel row data of the current input image data is output when the difference between the total load value of the previous input image data and the total load value of the current input image data is out of a predetermined difference range and when an accumulated load value is less than a predetermined threshold load value.

2. The display apparatus of claim 1, wherein the scale factor decreases as the total load value of the previous input image data increases.

3. The display apparatus of claim 2, wherein the scale factor has a same value as a first reference scale factor when the total load value of the previous input image data is less than or equal to the predetermined threshold load value.

4. The display apparatus of claim 3, wherein the first reference scale factor is 1.

5. The display apparatus of claim 4, wherein the driving controller applies the scale factor to the current input image data when a difference between the total load value of the previous input image data and the total load value of the current input image data is within the difference range.

6. The display apparatus of claim 5, wherein the driving controller does not apply the scale factor to the current input image data when the difference between the total load value of the previous input image data and the total load value of the current input image data is out of the difference range.

7. The display apparatus of claim 6, wherein the driving controller sequentially accumulates a load value per pixel row of current output image data to calculate the accumulated load value when the difference between the total load value of the previous input image data and the total load value of the current input image data is out of the difference range.

8. The display apparatus of claim 7, wherein the second reference scale factor is 1.

9. The display apparatus of claim 8, wherein the driving controller applies a third reference scale factor to the next pixel row data of the current input image data for the next pixel row next to the current pixel row to which the current pixel row data of the current input image data is output when the difference between the total load value of the previous input image data and the total load value of the current input image data is out of the difference range and when the accumulated load value is greater than or equal to the threshold load value.

10. The display apparatus of claim 9, wherein the third reference scale factor is 0.

11. A method of driving a display apparatus, the method comprising:

determining a scale factor based on a total load value of previous input image data, comparing the current input image data with the previous input image data to generate a comparing result;

determining whether to apply the scale factor to the current input image data based on the comparing result; and generating current output image data based on the current input image data, wherein comparing the current input image data with the previous input image data includes:

comparing a total load value of the current input image data with the total load value of the previous input image data, and wherein a second reference scale factor is applied to next pixel row data of the current input image data for a next pixel row next to a current pixel row to which current pixel row data of the current input image data is output when the comparing result indicates that the difference between the total load value of the previous input image data and the total load value of the current input image data is out of a predetermined difference range and when an accumulated load value is less than a predetermined threshold load value.

12. The method of claim 11, wherein the scale factor decreases as the total load value of the previous input image data increases.

13. The method of claim 12, wherein the scale factor has a same value as a first reference scale factor when the total load value of the previous input image data is less than or equal to the predetermined threshold load value.

14. The method of claim 13, wherein the scale factor is applied to the current input image data when the comparing result indicates that a difference between the total load value of the previous input image data and the total load value of the current input image data is within the difference range.

15. The method of claim 14, further comprising:

sequentially accumulating a load value per pixel row of the current output image data to calculate the accumulated load value when the comparing result indicates that the difference between the total load value of the previous input image data and the total load value of the current input image data is out of the difference range.

16. The method of claim 15, wherein a third reference scale factor is applied to the next pixel row data of the current input image data for the next pixel row next to the current pixel row to which the current pixel row data of the current input image data is output when the comparing result indicates that the difference between the total load value of the previous input image data and the total load value of the current input image data is out of the difference range and when the accumulated load value is greater than or equal to the threshold load value.

* * * * *